US008519283B2

(12) United States Patent
Whitaker et al.

(10) Patent No.: US 8,519,283 B2
(45) Date of Patent: Aug. 27, 2013

(54) COVER ASSEMBLY WITH ELECTRICAL SWITCHING APPARATUS

(75) Inventors: Thomas Alan Whitaker, North Huntingdon, PA (US); Yuri C. Spitsberg, Export, PA (US)

(73) Assignee: Eaton Corporation, Cleveland, OH (US)

( * ) Notice: Subject to any disclaimer, the term of this patent is extended or adjusted under 35 U.S.C. 154(b) by 260 days.

(21) Appl. No.: 13/005,824

(22) Filed: Jan. 13, 2011

(65) Prior Publication Data

US 2011/0174599 A1 Jul. 21, 2011

Related U.S. Application Data

(60) Provisional application No. 61/296,816, filed on Jan. 20, 2010.

(51) Int. Cl.
*H01H 9/28* (2006.01)

(52) U.S. Cl.
USPC ..... 200/43.22

(58) Field of Classification Search
USPC ..... 200/43.01, 43.11, 43.14–43.16, 43.19, 200/43.22, 333
See application file for complete search history.

(56) References Cited

U.S. PATENT DOCUMENTS 4,260,861 A 4/1981 DiMarco
4,978,816 A 12/1990 Castonguay et al.
5,936,214 A * 8/1999 Phillips ..... 200/43.22
6,423,913 B1 * 7/2002 Gupta et al. ..... 200/50.11
7,348,504 B2 * 3/2008 Brojanac ..... 200/43.22

FOREIGN PATENT DOCUMENTS

WO 01/71743 A2 9/2001

OTHER PUBLICATIONS

European Patent Office, "Communication-extended European search report", May 11, 2011, 5 pp.

* cited by examiner

*Primary Examiner* — Edwin A. Leon
*Assistant Examiner* — Anthony R. Jimenez
(74) *Attorney, Agent, or Firm* — Eckert Seamans Cherin & Mellott, LLC; Brij K. Agarwal

(57) ABSTRACT

An improved cover assembly for use with an electrical switching apparatus can be said to comprise a retention device that is structured to be disposed on the electrical switching apparatus and a cover that comprises an engagement element and that is disposed on the retention device. The cover is translatable between a first configuration and a second configuration and is configured such that a locking element will resist movement of the cover toward the second configuration. In the first configuration, the engagement element and the retention device confront one another to resist movement of the cover away from the electrical switching apparatus. However, in the second configuration, the engagement element and the retention device are clear of one another and enable the cover to be pivoted away from the electrical switching apparatus to provide access to the control elements of the switching apparatus.

7 Claims, 4 Drawing Sheets

COVER ASSEMBLY WITH ELECTRICAL SWITCHING APPARATUS

CROSS REFERENCE TO RELATED APPLICATION

The present specification claims priority from U.S. Provisional Patent Application No. 61/296,816, filed Jan. 20, 2010. Its contents are incorporated herein by reference.

BACKGROUND OF THE INVENTION

1. Field of the Invention

The present invention relates generally to an electrical switching apparatus and, more particularly, to a cover assembly for use in conjunction with an electrical switching apparatus.

2. Description of the Related Art

Numerous types of electrical switching apparatuses are known, and these would include circuit breakers, including molded case circuit breakers and other circuit breakers. An electrical switching apparatus can be employed, for instance, to interrupt current to a circuit in predetermined circumstances such as over-current conditions and other conditions. Such an electrical switching apparatus can also be employed to switch a circuit to an OFF condition such as when testing, maintenance, or repair is required of components within the circuit.

An electrical switching apparatus typically has one or more sets of separable contacts, and such contacts typically are in an OPEN condition when the electrical switching apparatus is in an OFF condition. Such sets of contacts are electrically connected together in a CLOSED condition when the electrical switching apparatus is in an ON condition.

While electrical switching apparatuses have been generally effective for their intended purposes, they have not been without limitation. In the instance where work must be performed on a circuit that is protected by an electrical switching apparatus, such as during testing, maintenance, or repair on the circuit, it is desirable that the electrical switching apparatus not only be in an OFF condition but that the electrical switching apparatus will stay in such OFF condition with a high degree of reliability. That is, it is desirable to avoid the switching of a circuit breaker or other electrical switching apparatus from its OFF condition to an ON condition by accident, by inadvertence, or by unknowing personnel who are unaware that the circuit breaker is supposed to remain in its OFF condition. Technicians who perform such testing, maintenance, and repair typically will carry a personal locking device such as a padlock that they personally will apply to an electrical switching apparatus to restrict access to the electrical switching apparatus during the time when such testing, maintenance, or repair is being conducted and will not remove the locking device until the technician's testing, maintenance, or repair work has been completed. However, locking devices can be of various dimensions, and mechanisms that restrict access to an electrical switching apparatus must accommodate such a variety of locking apparatuses with varying dimensions. In order to accommodate such a range of locking devices, electrical switching apparatuses typically will be configured to accept relatively large locking devices, such as large padlocks with large shackles, and they thereby will also be able to accept relatively smaller locking devices. However, if a technician employs a small lock with a small shackle on an electrical switching apparatus that can accommodate a large lock with a large shackle, the use of such a small lock can permit some play within the locking mechanism which may allow at least a limited degree of access to the circuit breaker, which is undesirable. It therefore is needed to provide an improved system for limiting access to the control elements of an electrical switching apparatus.

SUMMARY OF THE INVENTION

An improved cover assembly for use with an electrical switching apparatus can be said to comprise a retention device that is structured to be disposed on the electrical switching apparatus and a cover that comprises an engagement element and that is disposed on the retention device. The cover is translatable between a first configuration and a second configuration and is configured such that a locking element will resist movement of the cover toward the second configuration. In the first configuration, the engagement element and the retention device confront one another to resist movement of the cover away from the electiical switching apparatus. However, in the second configuration, the engagement element and the retention device are clear of one another and enable the cover to be pivoted away from the electrical switching apparatus to provide access to the control elements of the switching apparatus.

Accordingly, an aspect of the present invention is to provide an improved cover assembly for use with an electrical switching apparatus to enable a greater degree of restriction of access to the control elements of the electrical switching apparatus.

Another aspect of the invention is to provide an improved cover assembly that provides an improved degree of restricted access to an electrical switching apparatus when used in conjunction with any of a variety of locking elements having varying cross-sectional dimensions.

Another aspect of the invention is to provide an improved cover assembly that is easy to use but that provides an enhanced degree of security to the control elements of an electrical switching apparatus.

These and other aspects of the invention are provided by an improved cover assembly structured for use with an electrical switching apparatus and a movable locking element, wherein the locking element can be of any cross-sectional dimensions within a predetermined range of cross-sectional dimensions. The general nature of such a cover assembly can be generally stated as comprising a retention device that is structured to be disposed on the electrical switching apparatus, and a cover comprising an engagement element. One of the retention device and the cover is movable with respect to the other of the retention device and the cover between a first configuration of the cover assembly and a second configuration of the cover assembly and is structured to be engageable with the locking element to resist movement toward the second configuration of the cover assembly. At least a portion of the retention device and at least a portion of the engagement element in the first configuration of the cover assembly confront one another to resist movement of at least a portion of the cover away from the electrical switching apparatus. The at least portion of the retention device and the at least portion of the engagement element in the second configuration of the cover assembly are clear of one another to permit movement of at least a portion of the cover away from the electrical switching apparatus between the second configuration of the cover assembly and a third configuration of the cover assembly.

BRIEF DESCRIPTION OF THE DRAWINGS

A full understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
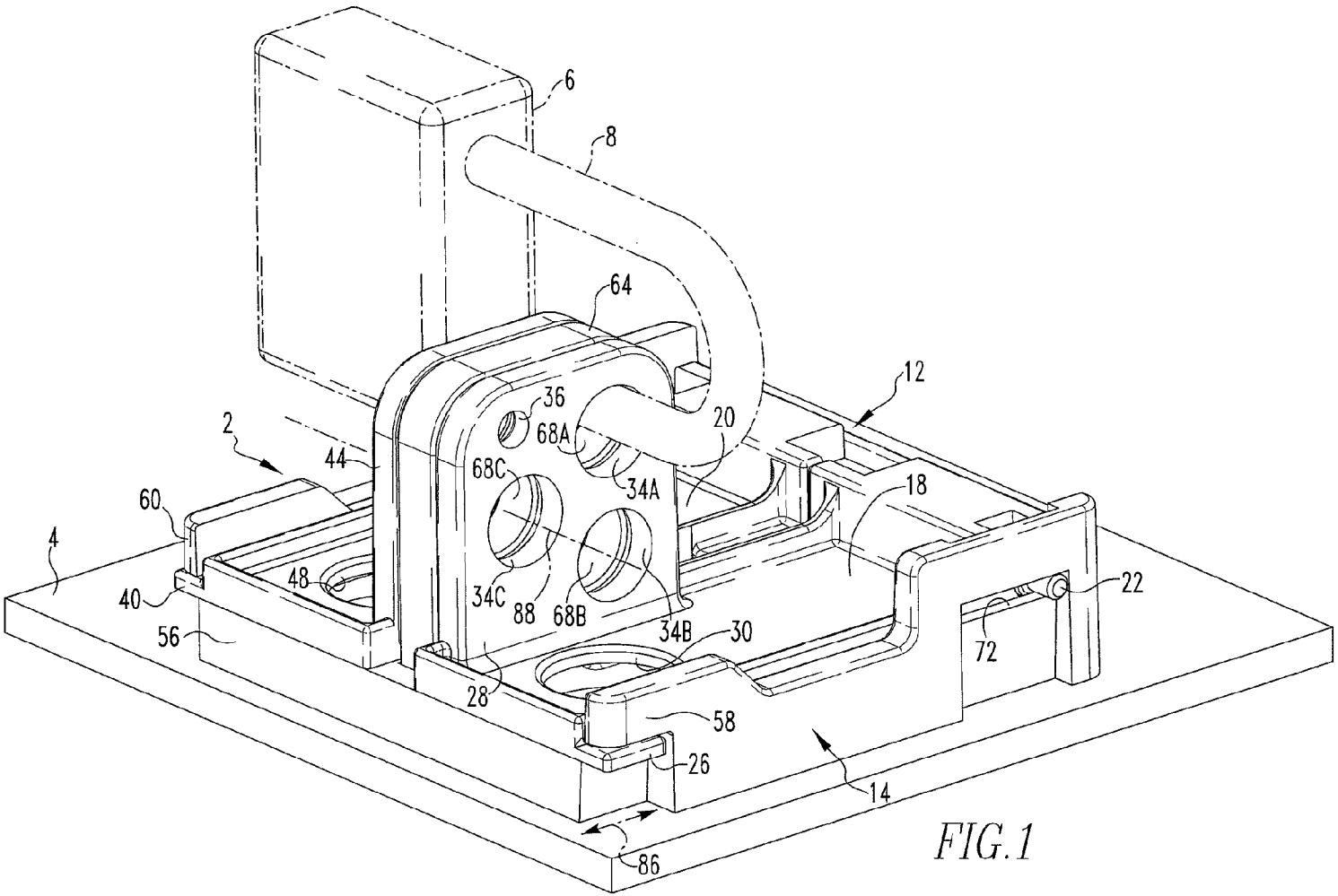
FIG. 1 is a perspective view of an improved cover assembly disposed on a schematically depicted electrical switching apparatus and with a locking element that is depicted in broken lines, and with the cover assembly being depicted in a first configuration.

An improved cover assembly 2 in accordance with the present invention is depicted generally in FIGS. 1-4. The cover assembly 2 can be employed in conjunction with an electrical switching apparatus such as the schematically depicted circuit breaker 4 of FIG. 1. The circuit breaker 4 comprises a number of sets of separable contacts and an operating mechanism that is configured to separate the contacts in one or more predetermined circumstances. The cover assembly 2 is mounted to the circuit breaker 4 over certain control elements (not expressly depicted herein) of the circuit breaker 4 such as an OPEN pushbutton, a CLOSED pushbutton, and the like. The cover assembly 2 can be employed in conjunction with a locking element 6 which is depicted in FIG. 1 in broken lines and which includes a shackle 8 that is likewise depicted in broken lines. Advantageously, the cover assembly 2 is configured to accommodate a wide variety of locking elements 6, such as locking elements having shackles 8 with any cross-sectional dimensions within a predetermined range of cross-sectional dimensions. In the exemplary embodiment depicted herein, the improved cover assembly 2 is configured to accommodate shackles 8 having circular cross-sectional diameters within the range of about 0.1875-0.3125 inches, although it is understood that such an exemplary range is not intended to be limiting on the claimed concept.

The cover assembly 2 can be broadly characterized as comprising a cover 12 disposed on a retention device 14. However, the exemplary cover 12 comprises a first cover member 18 and a second cover member 20 that are configured to cover and restrict access to the aforementioned control elements (not expressly depicted herein) of the circuit breaker 4.

The first and second cover members 18 and 20 are mirror images of one another and are mounted to an axle 22 which is, in turn, disposed on the retention device 14 and which enables pivoting movement of the first and second cover members 18 and 20 with respect to the retention device 14, as will be set forth in greater detail elsewhere herein. As can be understood from the figures provided herewith, the cover 12 further comprises a first engagement element 26 and a first bolt member 28 disposed on the first cover member 18, and additionally comprises a second engagement element 40 and a second bolt member 44 disposed on the second cover member 20. The first cover member 18 additionally has a first window 30 formed therein which provides visual access to a visual indicator of the circuit breaker 4. The first bolt member 28 has formed therein a plurality of first openings 34*a*, 34*b*, and 34*c* which are sized to receive the shackle 8 of the locking element 6, with the first openings 34*a*, 34*b*, and 34*c* being sized to accommodate therein shackles 8 of various cross-sectional dimensions within a predetermined range of cross-sectional dimensions. The first bolt member 28 further has a first thru-bore 36 formed therein which can receive therein a tamper-evident seal (not expressly depicted herein).

Inasmuch as the first and second cover members 18 and 20 are mirror images of one another, it can be understood that the second cover member 20 has a second window 48 formed therein, and the second bolt member 44 has formed therein a plurality of second openings 50*a*, 50*b*, and 50*c*, as well as a second thru-bore 52.

The retention device 14 can be said to comprise a base 56, a first latch 58, a second latch 60, and a third bolt member 64. The third bolt member 64 is similar to the first and second bolt members 28 and 44 and has formed therein a plurality of third openings 68*a*, 68*b*, and 68*c* as well as a third thru-bore 70.

Figure 2:
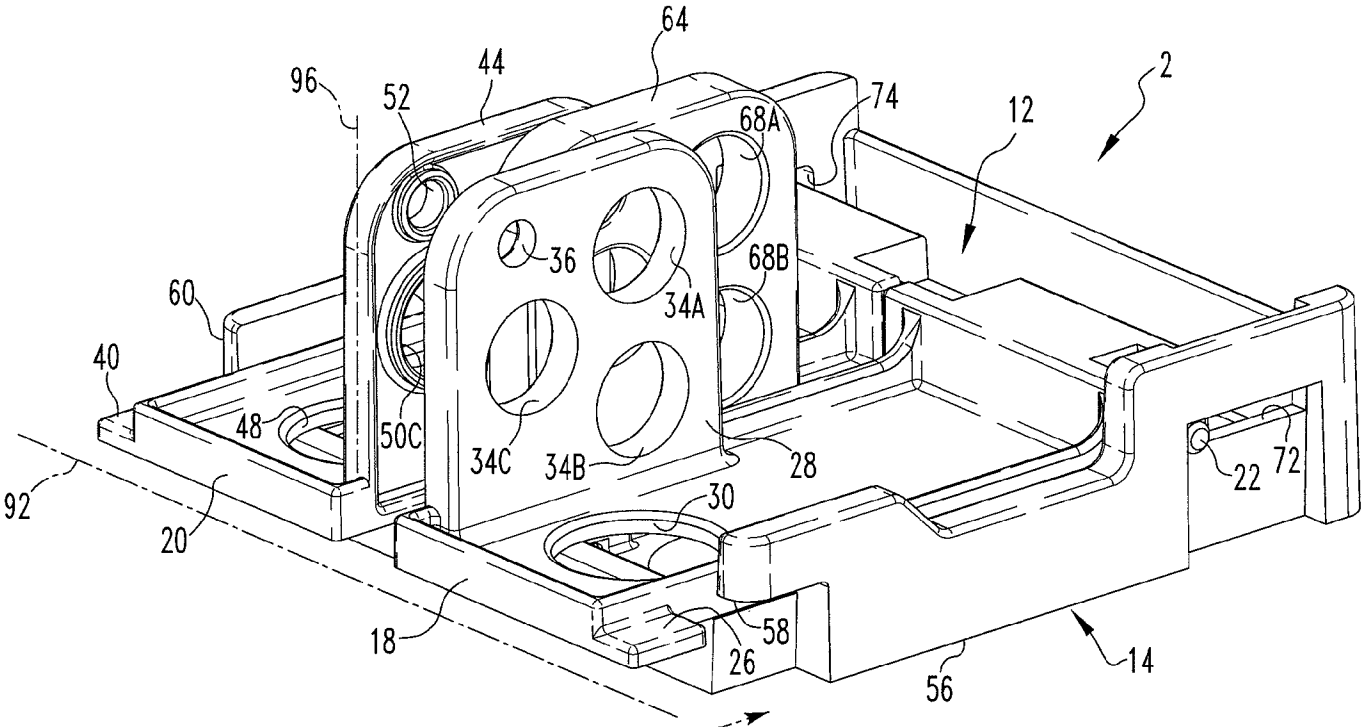
FIG. 2 is a perspective view of the cover assembly of FIG. 1 in a second configuration.

As can be understood from FIGS. 1 and 2, the cover 12 is translatable with respect to the retention device 14 between a first configuration of the cover assembly 2, as is depicted generally in FIG. 1, and a second configuration of the cover assembly 2, as is indicated generally in FIG. 2. The cover 12 is translatable along a first axis 86 between the first and second configurations when the shackle 8 of the locking element 6 is absent from the cover assembly 2. That is, in the first configuration, it can be seen that the first openings 34*a*, 34*b*, and 34*c*, the second openings 50*a*, 50*b*, and 50*c*, and the third openings 68*a*, 68*b*, and 68*c* are aligned with one another. More particularly, in the first configuration of the cover assembly 2, the first, second, and third openings 34*a*, 50*a*, and 68*a* are aligned with one another. Similarly, in the same first configuration the first, second, and third openings 34*b*, 50*b*, and 68*b* are aligned with one another. Likewise, in the same first configuration, the first, second, and third openings 34*c*, 50*c*, and 68*c* are aligned with one another. Such an alignment is indicated with a second axis 88 with respect to the first, second, and third openings 34*c*, 50*c*, and 68*c*, but it is understood that all three sets of openings are aligned with one another in the first configuration. This advantageously permits, for instance, a plurality of locking elements, such as the locking element 6 to be simultaneously received on the cover assembly 2, such as when a plurality of technicians are performing different testing, maintenance, or repair tasks and who would all mount a personal locking element in one of the sets of aligned openings to resist access to the control elements of the circuit breaker 4 until all of the locking elements have been removed from the cover assembly 2.

It can further be understood that the first, second, and third thru-bores 36, 52, and 70 are aligned with one another in the first configuration of the cover assembly 2 and are configured to receive a tamper-evident seal (not expressly depicted herein) therethrough. Such a tamper-evident seal might comprise a wire and a lead fastener which is removable without substantial difficulty yet would indicate the fact of such removal and would further indicate that someone has gained access to the control elements of the circuit breaker 4.

It can be understood from FIGS. 1 and 2, therefore, that the translation of the cover 12 along the first axis 86 is permissible when the locking elements 6 are removed from the first, second, and third openings 34*a-c*, 50*a-c*, and 68*a-c*, and when any tamper-evident seal is removed from the first, second, and third thru-bores 36, 52, and 70. It likewise can be seen that the existence of any such locking element 6 in any of the sets of first, second, and third openings 34*a-c*, 50*a-c*, and 68*a-c* in the first configuration will resist movement of the cover 12 toward the second configuration of the cover assembly 2. That is, while a shackle 8 having a relatively smaller cross-sectional diameter that is received on the cover assembly 2 in the first configuration will permit a greater degree of translation of the cover 12 toward the second configuration than would be permitted by a shackle 8 having a relatively larger cross-sectional diameter, any such shackle 8 will resist movement of the cover 12 toward the second configuration so as to resist the reaching of the second configuration. As can be understood from FIG. 1, the exemplary second axis 88 is substantially perpendicular to the first axis 86, and thus a shackle 8 of a locking element received in any of the aligned sets of openings 34*a-c*, 50*a-c*, and 68*a-c* will resist movement along the first axis 86 to the second configuration.

As can be understood from FIGS. 1 and 2, the first and second engagement elements 26 and 40 confront the first and second latches 58 and 60, respectively, and such confrontation resists movement of the cover 12 in a direction away from the circuit breaker 4. However, and as can be seen in FIG. 2, when the cover 12 is in the second configuration of the cover assembly 2, the first and second engagement elements 26 and 40 are clear of the first and second latches 58 and 60, thereby permitting pivoting movement of the first cover member 18 or the second cover member 20 or both between the second configuration and a third configuration, such as is indicated in FIG. 4 wherein the first cover member 18 is depicted in the third configuration pivoted away from the circuit breaker 4 while the second cover member 20 is not pivoted in such a fashion.

Figure 3:
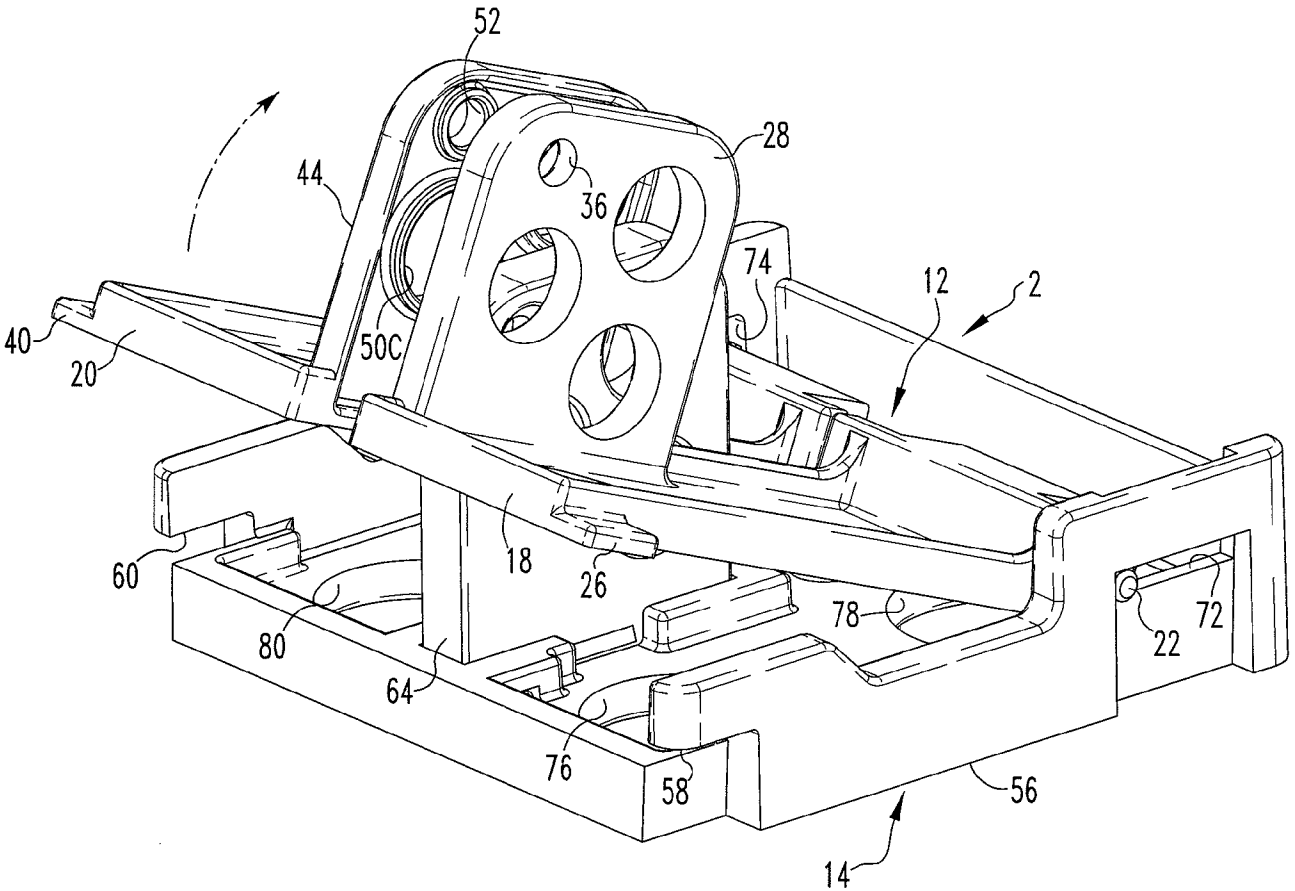
FIG. 3 is a perspective view of the cover assembly of FIG. 1 with a cover thereof being in a position between the second configuration and a third configuration.

As can be understood from the accompanying figures, a first end of the axle 22 is movably received in a first slot 72 formed in the base 56, and it can further be understood from FIGS. 2 and 3 that a second end of the axle 22 is received in a second slot 74 that is likewise formed in the base 56. In the depicted exemplary embodiment, the first and second cover members 18 and 20 translate simultaneously between the first and second configurations, but in the second configuration the first and second cover members 18 and 20 are independently pivotable between the second orientation and the third orientation. FIG. 3 depicts the first and second cover members 18 and 20 being substantially simultaneously pivoted toward the third configuration. FIG. 4 depicts the first cover member 18 pivoted to its third configuration and with the second cover member 20 being translated back to its first configuration whereby the second engagement element 40 and the second latch 60 confront one another and resist movement of the second cover member 20 away from the circuit breaker 4. It is understood that in FIG. 4 the first cover member 18 is depicted as having been translated along the first axis 86 with the second cover member 20, but as being independently pivotable since it was pivoted away from the circuit breaker 4 prior to translation of the second cover member 20 back to its first configuration. As such, it can be understood that the first and second cover members 18 and 20 are translatable together along the first axis 86 but are independently pivotable from the second configuration.

Figure 4:
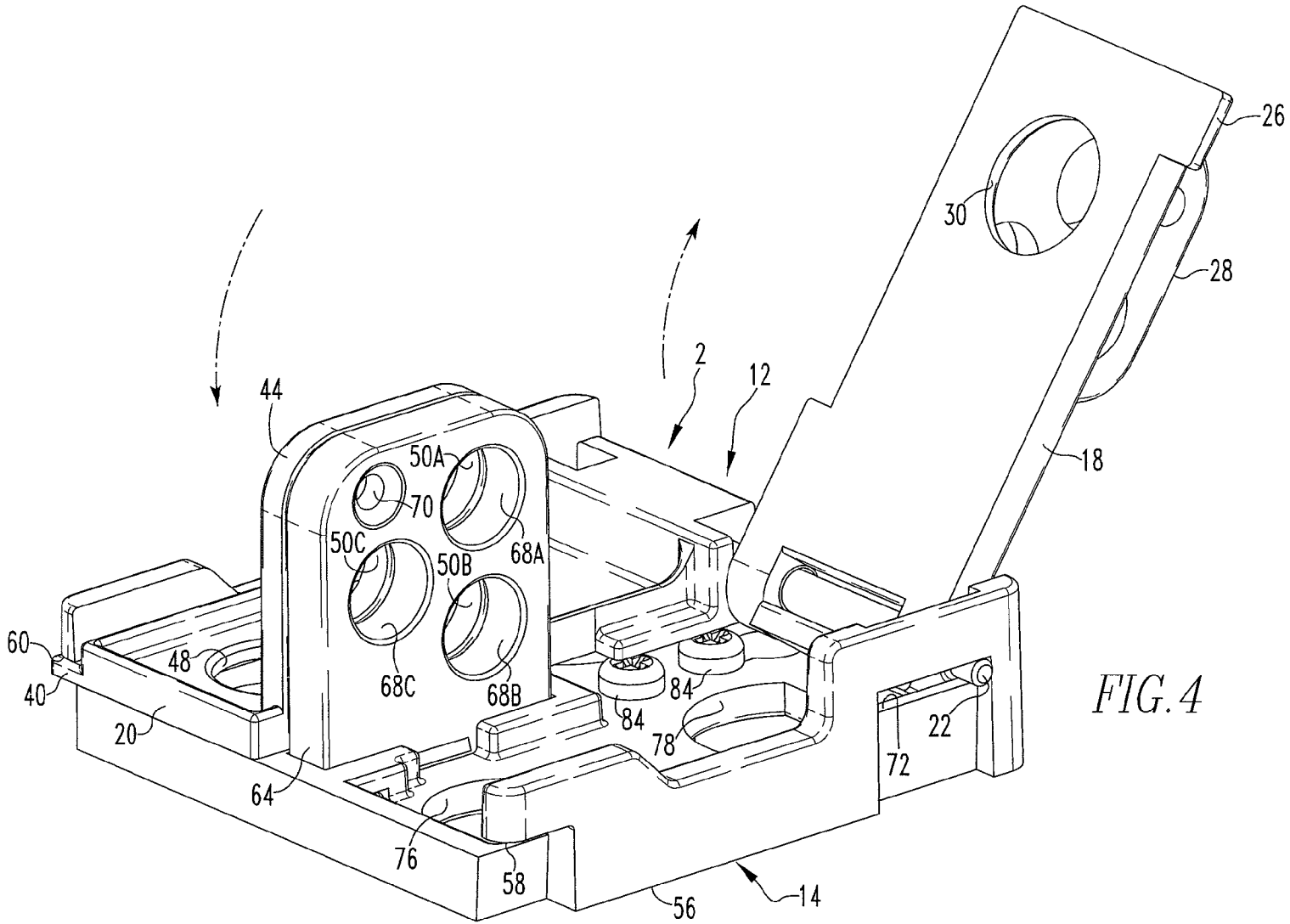
FIG. 4 is a perspective view of the cover assembly of FIG. 1 with a first cover member in the third configuration and with a second cover member in the first configuration.

As can be understood from FIGS. 3 and 4, the base 56 has a first viewport 76 and a second viewport 80 formed therein that provide visual access to visual indicators of the circuit breaker 4. When the first cover member 18 is in the first configuration, the first window 30 is aligned with the first viewport 76 to permit such visual access through both the first window 30 and the first viewport 76 to a visual indicator (not expressly depicted herein) of the circuit breaker 4, and the second window 48 is similarly aligned with the second viewport 80 when the second cover member 20 is in its first configuration as in FIGS. 1 and 4.

It can also be understood from FIGS. 3 and 4 that the base 56 further has a pair of access holes 78 formed therein, only one of which is visible in FIGS. 3 and 4, but the other of which is formed in a mirror-image fashion on the opposite side of the base 56. An access hole 78 is visible when its respective first cover member 18 or second cover member 20 is in the third configuration, thereby permitting access to a pushbutton or other control element of the circuit breaker 4. As can also be seen in FIG. 4, the cover assembly 2 is mounted to the circuit breaker 4 with a pair of fasteners 84 which are covered by the cover 12 when the first and second cover members 18 and 20 are in the first configuration.

As can be understood from FIGS. 1 and 2, the first and second engagement elements 26 and 40 protrude in opposite directions from the first and second cover members 18 and 20, as is depicted along a first direction which is indicated in FIG. 2 at the numeral 92. It can further be seen from FIGS. 1 and 2 that in the first and second configurations, the first and second bolt members 28 and 44 protrude from the first and second cover members 18 and 20, respectively, along a second direction 96 which is substantially perpendicular to the first direction 92. In this regard, the first and second bolt members 28 and 44 are disposed substantially parallel with one another in the first and second configurations. Furthermore, in the first and second configurations, the first bolt member 64 is disposed between the first and second bolt members 28 and 44 and likewise protrudes from the base 56 in the second direction 96.

It thus can be seen that the improved cover assembly 2 restricts access to the control elements of the circuit breaker 4 by resisting movement of its cover 12 from the first configuration toward the second configuration when a shackle 8 of a locking element 6 is received in any set of aligned openings, such as the first, second, and third openings 34*a*, 50*a*, and 68*a*, or other aligned sets of openings as discussed elsewhere herein. By resisting such movement toward the second configuration, the first and second engagement elements 26 and 40 confront the first and second latches 58 and 60, respectively, to resist movement of the first and second cover members 18 and 20 away from the circuit breaker 4. Since the first and second cover members 18 and 20 are resisted from moving away from the circuit breaker 4 until all such locking elements 6 are removed from the first, second, and third bolt members 28, 44, and 64, the cover assembly 2 advantageously can provide the same restriction of access to the control elements of the circuit breaker 4 regardless of the cross-sectional dimensions of the shackle 8 of any locking element 6. The first and second cover members 18 and 20 are independently pivotable between the second and third configurations if needed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A cover assembly structured for use with an electrical switching apparatus and a movable locking element, the locking element being of a cross-sectional dimension, the cover assembly comprising:

a retention device being structured to be disposed on the electrical switching apparatus;

a cover comprising an engagement element;

one of the retention device and the cover being translatable with respect to the other of the retention device and the cover between a first configuration of the cover assembly and a second configuration of the cover assembly and being structured to be engageable with the locking element to resist movement toward the second configuration of the cover assembly;

at least a portion of the retention device and at least a portion of the engagement element in the first configuration of the cover assembly confronting one another to resist movement of at least a portion of the cover away from the electrical switching apparatus;

the at least portion of the retention device and the at least portion of the engagement element in the second configuration of the cover assembly being clear of one another to permit movement of at least a portion of the cover away from the electrical switching apparatus between the second configuration of the cover assembly and a third configuration of the cover assembly;

wherein the cover is translatable between the first and second configurations of the cover assembly and is pivotable between the second and third configurations of the cover assembly; and wherein the cover is translatable along a first axis between the first and second configurations of the cover assembly, and wherein the retention device and the engagement element each have an opening formed therein that is structured to receive therein at least a portion of the locking element, the openings in the first configuration of the cover assembly being aligned with one another along a second axis, the first axis and the second axis being oriented substantially perpendicular to one another.

2. The cover assembly of claim 1 wherein the cover further comprises a first cover member and a second cover member, the first cover member having a first opening formed therein, the second cover member having a second opening formed therein, and the retention device having a third opening formed therein, the first, second, and third openings being aligned with one another in the first configuration of the cover assembly and being structured to receive at least a portion of the locking element therein.

3. The cover assembly of claim 1 wherein the cover further comprises a first cover member, a second cover member, and an axle, the first and second cover members being disposed on the axle, the axle being disposed in at least a first slot formed in the retention device and being slidable in the at least first slot along the first axis between the first and second configurations of the cover assembly.

4. A cover assembly structured for use with an electrical switching apparatus and a movable locking element, the locking element being of a cross-sectional dimension, the cover assembly comprising:

a retention device being structured to be disposed on the electrical switching apparatus;

a cover comprising an engagement element;

one of the retention device and the cover being translatable with respect to the other of the retention device and the cover between a first configuration of the cover assembly and a second configuration of the cover assembly and being structured to be engageable with the locking element to resist movement toward the second configuration of the cover assembly;

at least a portion of the retention device and at least a portion of the engagement element in the first configuration of the cover assembly confronting one another to resist movement of at least a portion of the cover away from the electrical switching apparatus;

the at least portion of the retention device and the at least portion of the engagement element in the second configuration of the cover assembly being clear of one another to permit movement of at least a portion of the cover away from the electrical switching apparatus between the second configuration of the cover assembly and a third configuration of the cover assembly;

wherein the cover is translatable between the first and second configurations of the cover assembly and is pivotable between the second and third configurations of the cover assembly; and wherein the cover is translatable along a first axis between the first and second configurations of the cover assembly, and wherein the cover further comprises at least a first cover member, the engagement element being disposed on the at least first cover member and protruding therefrom in a direction substantially perpendicular to the first axis.

5. The cover assembly of claim 4 wherein the cover further comprises a second cover member and a second engagement element, the second engagement element being disposed on the second cover member and protruding therefrom in a direction generally away from the engagement element and substantially perpendicular to the first axis.

6. A cover assembly structured for use with an electrical switching apparatus and a movable locking element, the locking element being of a cross-sectional dimension, the cover assembly comprising:

a retention device being structured to be disposed on the electrical switching apparatus;

a cover comprising an engagement element;

one of the retention device and the cover being translatable with respect to the other of the retention device and the cover between a first configuration of the cover assembly and a second configuration of the cover assembly and being structured to be engageable with the locking element to resist movement toward the second configuration of the cover assembly;

at least a portion of the retention device and at least a portion of the engagement element in the first configuration of the cover assembly confronting one another to resist movement of at least a portion of the cover away from the electrical switching apparatus;

the at least portion of the retention device and the at least portion of the engagement element in the second configuration of the cover assembly being clear of one another to permit movement of at least a portion of the cover away from the electrical switching apparatus between the second configuration of the cover assembly and a third configuration of the cover assembly;

wherein the cover is translatable between the first and second configurations of the cover assembly and is pivotable between the second and third configurations of the cover assembly; and wherein the engagement element is a first engagement element, and wherein the cover further comprises a first cover member, a first bolt member, a second cover member, a second bolt member, and a second engagement element, the first bolt member and the first engagement element being disposed on the first cover member, the second bolt member and the second engagement element being disposed on the second cover member, the first engagement element protruding from the first cover member and the second engagement element protruding from the second cover member in directions generally away from one another, and wherein the retention device comprises a base, a pair of latches, and a third bolt member, the first and second bolt members protruding from the first and second cover members substantially parallel to one another and in a direction substantially perpendicular to the direction along which the first engagement element and the second engagement element protrude from the first and second cover members, the third bolt member being disposed between the first and second bolt members in the first configuration of the cover assembly.

7. An electrical switching apparatus structured for use with a movable locking element and the cover assembly of claim 1.

* * * * *